US006421977B2

(12) United States Patent
Timperman et al.

(10) Patent No.: US 6,421,977 B2
(45) Date of Patent: Jul. 23, 2002

(54) REINFORCEMENT STIRRUP FOR USE IN MASONRY, AS WELL AS MASONRY THUS FORMED

(75) Inventors: Pol Timperman, Zwevegem (BE); Harry Steller, Oeynhausen (DE)

(73) Assignee: N.V. Bekaert S.A., Zwevegem (BE)

( * ) Notice: Subject to any disclaimer, the term of this patent is extended or adjusted under 35 U.S.C. 154(b) by 0 days.

(21) Appl. No.: 09/858,870

(22) Filed: May 17, 2001

Related U.S. Application Data

(63) Continuation of application No. PCT/EP99/08690, filed on Nov. 5, 1999.

(30) Foreign Application Priority Data

Nov. 17, 1998 (NL) ..... 1010572

(51) Int. Cl.[7] ..... E04C 1/38
(52) U.S. Cl. ..... 52/714; 52/677
(58) Field of Search ..... 52/714, 677, 698, 52/700, 600, 712, 680

(56) References Cited

FOREIGN PATENT DOCUMENTS

| | | |
|---|---|---|
| DE | 297 13 212 | 9/1997 |
| DE | 297 14 888 | 10/1997 |
| DE | 296 18 030 | 11/1997 |
| EP | 0 603 517 | 7/1997 |
| WO | WO00/29690 | 5/2000 |

*Primary Examiner*—Carl D. Friedman
*Assistant Examiner*—Naoko Slack
(74) *Attorney, Agent, or Firm*—Shlesinger, Arkwright & Garvey LLP

(57) ABSTRACT

Reinforcement stirrup for use in masonry includes a support section and a flat stirrup leg extending vertically relative to it. The stirrup leg is inserted in a joint between constructional elements. A positioner positions an essentially horizontally extending main reinforcement. The stirrup leg is positioned in relative to the support section so that the support section of the stirrup leg inserted into a joint between two constructional elements contacts them. The positioner for a main reinforcement may be a hook. A further positioner positions of the reinforcement stirrup relative to a constructional element with which it cooperates, so that an in line positioning of the reinforcement stirrups in relation to one another can easily be achieved. Masonry construction may be provided with a main reinforcement running essentially horizontally and that is positioned with the aid of the reinforcement stirrups.

40 Claims, 2 Drawing Sheets

REINFORCEMENT STIRRUP FOR USE IN MASONRY, AS WELL AS MASONRY THUS FORMED

This application is a continuation of PCT/EP99/08690 filed Nov. 5, 1999.

This invention relates to a reinforcement stirrup made of wire material for use in masonry, comprising an essentially flat support section and at least one flat stirrup leg which, when the reinforcement stirrup is in use, extends essentially vertically up from the support section for inclusion in a joint between constructional elements, as well as positioning means or element for an essentially horizontally extended main reinforcement, which means, when in use, extend from the plane of the support section and lie essentially outside this plane and extend in a direction opposite to that of the stirrup leg, whereby the plane of the stirrup leg intersects the plane of the support section within the bounds of the support section, and whereby the positioning means are formed by a hook with the stem of the hook lying in the plane of the support section and the arm of the hook extending essentially parallel to the support section.

Such a reinforcement stirrup is already known from DE-U-29713212.

Said publication describes a reinforcement stirrup of the kind referred to in the introduction, said stirrup comprising one stirrup leg for inclusion in the joint between two bricks, which are to be laid adjacent to one another, with the support section resting upon the upper surface of the two adjacent bricks. The positioning means mentioned in the introduction are used to position the additional main reinforcement in relation to the reinforcement stirrup, as, for example, an essentially horizontally disposed reinforcement that runs between courses of laid bricks and is commonly used to reinforce masonry to such an extent that, for example, the use of a lintel in a frame is rendered unnecessary, the reinforced masonry here effectively replacing such lintel.

The reinforcement stirrup of the type known in the prior art procures usable results, which nevertheless involve certain disadvantages.

The fitting of the additional main reinforcement after the reinforcement stirrups have been fitted is not easy and requires either that the reinforcing elements be inserted into a course of brickwork from the side of a layer of bricks and shoved in over a long distance, or else that special parts of a reinforcement stirrup be manually moved above the main reinforcement to obtain a firm anchoring and correct positioning of the main reinforcement.

It is an object of the present invention to provide a solution to said disadvantages, and to this end the reinforcement stirrup referred to in the introduction is characterized in that the arm of the hook is situated at a distance from the plane of the support section which is substantially equal to the thickness of the main reinforcement and this arm is open at the front of the masonry so that this main reinforcement can be pushed in from the front of the masonry until it comes into contact with the stem of the hook.

The arm of the hook preferably extends in a plane within which the plane of the stirrup leg also extends.

The positioning means used to position an essentially horizontally extended main reinforcement are, by their shape, designed in such a manner as to ensure an easy and accurate positioning of the main reinforcement without the necessity of difficult lateral insertion or moving manually special parts of the reinforcement stirrup.

As said, the reinforcement stirrup according to the present invention is designed so that the arm of the hook for the positioning of the main reinforcement lies at a distance from the plane of the support section that is substantially equal to the thickness of the main reinforcement. The hooks used for positioning the main reinforcement project for some distance above the plane of the support section; these hooks are preferably oriented in a direction parallel to that of the stirrup leg in the joint, and are therefore parallel to the joint in which said stirrup leg is located. The laid course of constructional elements thus includes a number of hooks projecting above the course itself and above the support sections resting against the course; an additional main reinforcement can in a simple manner be pushed in from the front of the masonry until it comes into contact with the stem of the hook, and this provides an excellent and easy positioning of the main reinforcement.

Many different materials can be employed for such a main reinforcement. One suitable material for this purpose is sold under the brand name Murfor®, a reinforcement product of the applicant, N.V. Bekaert S.A., consisting of a steel wire construction comprising two longitudinally parallel wire components, these parallel wire components being connected with one another, for example, by means of zig-zag connecting wires secured at the tips to the wire-shaped reinforcing elements.

The reinforcement stirrup according to the invention is preferably provided with reinforcement stirrup positioning means for positioning the reinforcement stirrup in relation to a constructional element with which it cooperates.

Such reinforcement stirrup positioning means can be of many different kinds. The reinforcement stirrup positioning means according to the invention extend out from the plane of the support section and are situated below the plane of the support section, to the side of the stirrup leg.

Appropriately, the reinforcement stirrup positioning means comprise a protruding section whose end lies essentially in a plane in which at least one stirrup leg lies. The extremity is therefore situated below the plane of the support section and, with the placement of the reinforcement stirrup, the extremity comes into contact with a constructional element and the user can give this extremity a certain fixed position in relation, for example, to an identifying mark on each constructional element or, alternatively, to a vertical delimitation or some other aspect thereof. The reinforcement stirrups can be aligned perfectly in relation to each other by making the extremity of the protruding section of the reinforcement stirrup positioning means always hit the same point so that the insertion of a horizontally extending main reinforcement then presents no problems whatsoever, and a very solid result is obtained.

The reinforcement stirrup according to the invention is preferably made from a single length of wire, as will be discussed in the description.

The wire material for the reinforcement stirrup according to the invention can of course be of many different kinds, for example durable plastic such as Kevlar®, nylon or polycarbonate or, for that matter, of metal, such as steel wire.

The reinforcement stirrup according to the present invention is preferably made of steel wire of a thickness of between 2 mm and 8 mm, and by preference between 3 mm and 5 mm.

Appropriately, the steel wire of a reinforcement stirrup according to the invention is provided with adhesion-promoting profiles such as corrugations, roughening, ripples, etc. Any profile that produces an improved adhesion between the reinforcement stirrup and the mortar used in the joints can be selected, and the professional will know which profile is best suited for which application.

In connection with the present invention, reference is also made to EP-B-0 603 517. This publication describes an elongated reinforcing element of the type described above and designated as the applicant's product Murfor®. Said elongated reinforcing element makes use of stirrups that extend into the joint between two constructional elements and that can easily be hooked onto any horizontally extending constructional element which has already been placed. There is then no question of any positioning effect being exerted by such stirrups used for positioning the horizontally disposed reinforcing element; nor, in fact, do such stirrups contribute to the direct transfer of forces acting on them to constructional elements surrounding the stirrups.

The invention further relates to masonry that is at least fitted with an essentially horizontally oriented main reinforcement which is positioned by means of reinforcement stirrups, such masonry being characterized by the fact that the reinforcement is positioned with the aid of reinforcement stirrups according to the invention, as described above.

The invention will now be explained in more detail with reference to the drawings, in which.

Figure 1:
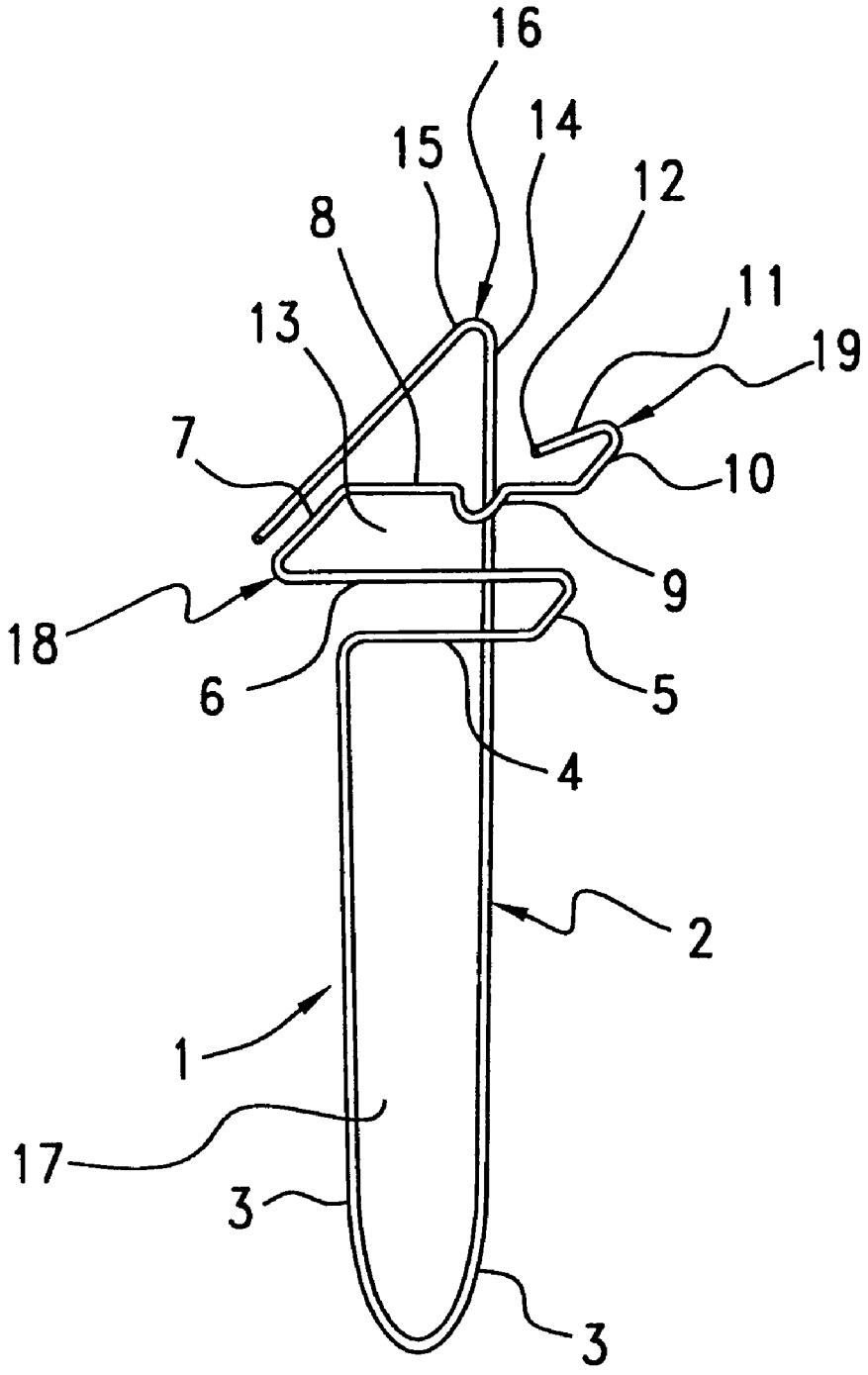
FIG. 1 represents a schematic view of a reinforcement stirrup according to the invention.

The general aspects of a reinforcement stirrup according to the invention are indicated by 1 in FIG. 1; the reinforcement stirrup 1 has a stirrup leg 2, with leg elements 3, which together form a plane 2 of a stirrup leg.

The plane 13 of the support section or the support plane 13 contains the wire elements 4, 5, 6, 7, 8, 9 and 10; these wire elements together are in contact with two constructional elements that are joined to each other across a joint. The plane 2 of the stirrup leg is also situated in the joint between said two constructional members. The numbers 14 and 15 indicate a hook that projects above the support plane 13 (=plane 13 of the support section), with the arm of the hook 15 preferably being situated essentially in the plane that also contains plane 2 of the stirrup leg. The arm of the hook 15 lies in a plane that is parallel with the plane of the support section 13 and at a distance which is substantially equal to the thickness of the main reinforcement. The arm of the hook is preferably rectilinear in shape; other shapes may also occur, such as sine-shaped corrugations. The upright section 14 of the hook originates within the plane of the support section 13 and, in the present case, is positioned in a positioning indentation 9, which is now oriented in the direction of the extremity of the arm 15 of the hook, but which may, of course, also be oriented in the opposite direction. It is also possible to omit the positioning indentation and to replace it with a weld or soldered attachment. As shown in the figure, the plane 2 of the stirrup leg is arranged in such a manner that this plane intersects the plane 13 in which the support section lies in such a way that the line of intersection is located within the limits of the plane of the support section. In other words, this configuration entails that the plane of the support section rests upon two constructional elements that are connected to each other through a joint which accommodates the stirrup leg of the element in question.

The exact shape of the elements 4 to 10 of the plane of the support section is not critical, provided that the support plane 13 is shaped in such a way as to procure a close fit upon two adjoining constructional elements.

A single stirrup leg with plane 2 is drawn in the reinforcement stirrup shown in this figure. There may, of course, be more than one stirrup leg, as for instance two. The stirrup leg is loop-shaped, which is due among others things to the fact that the reinforcement stirrup is made of a single length of wire. The reinforcement stirrup can also be made of different wire elements joined together for example by gluing or welding operations to produce a reinforcement stirrup according to the invention.

The stirrup leg 2 in the embodiment just mentioned does not necessarily have to be loop-shaped in order to be suitable for its intended function; an open, flat shape will also be perfectly suitable.

The number 11 indicates part of a reinforcement stirrup positioning means that has the shape of a protruding section 11 with an extremity 12 which touches up against some point (readily recognizable by the user) on the constructional element to which the reinforcing stirrup is in the first instance fitted. Such a reference point may be a fixed point formed by a reference point on the surface of a constructional element; alternatively, the extremity 12 of protruding section 11 may be brought into contact with the edge of a constructional element. In all cases, the correct positioning of the extremity 12 of protrusion 11 ensures that a reinforcement stirrup according to the invention occupies a fixed position in relation to the constructional elements, thus also guaranteeing the neat and tidy alignment of the reinforcement stirrups and the arms 15. This careful alignment then guarantees an easy and reproducible insertion of a horizontally oriented main reinforcement, as for example a Murfor® reinforcement.

The reinforcement stirrups 1 according to the invention are perfectly suitable for use in so-called "suspended masonry", with a suspension means built in which grips under the horizontal main reinforcement that is present between two courses of constructional elements.

The reinforcement stirrup 1 may be manufactured in various embodiments.

For grenadier brickwork, for example, the overall dimensions of the support section 13 are ±8 cm×4 cm, with a stirrup leg 2 that protrudes out of the plane of the support section over a distance of ±25 cm.

Standard bond masonry combines a support section 13 with dimensions of ±8 cm×4 cm and a stirrup leg 2 with a length of ±8 cm.

The term 'masonry' is here understood to mean both masonry with mortar joints and masonry with adhesive joints.

Depending on the environment in which the reinforcement stirrups according to the invention are to be used, they can be made of normal steel wire, epoxy-coated steel wire, hot-dip galvanized steel wire or stainless steel wire in those cases where steel is the chosen material.

Figure 2:
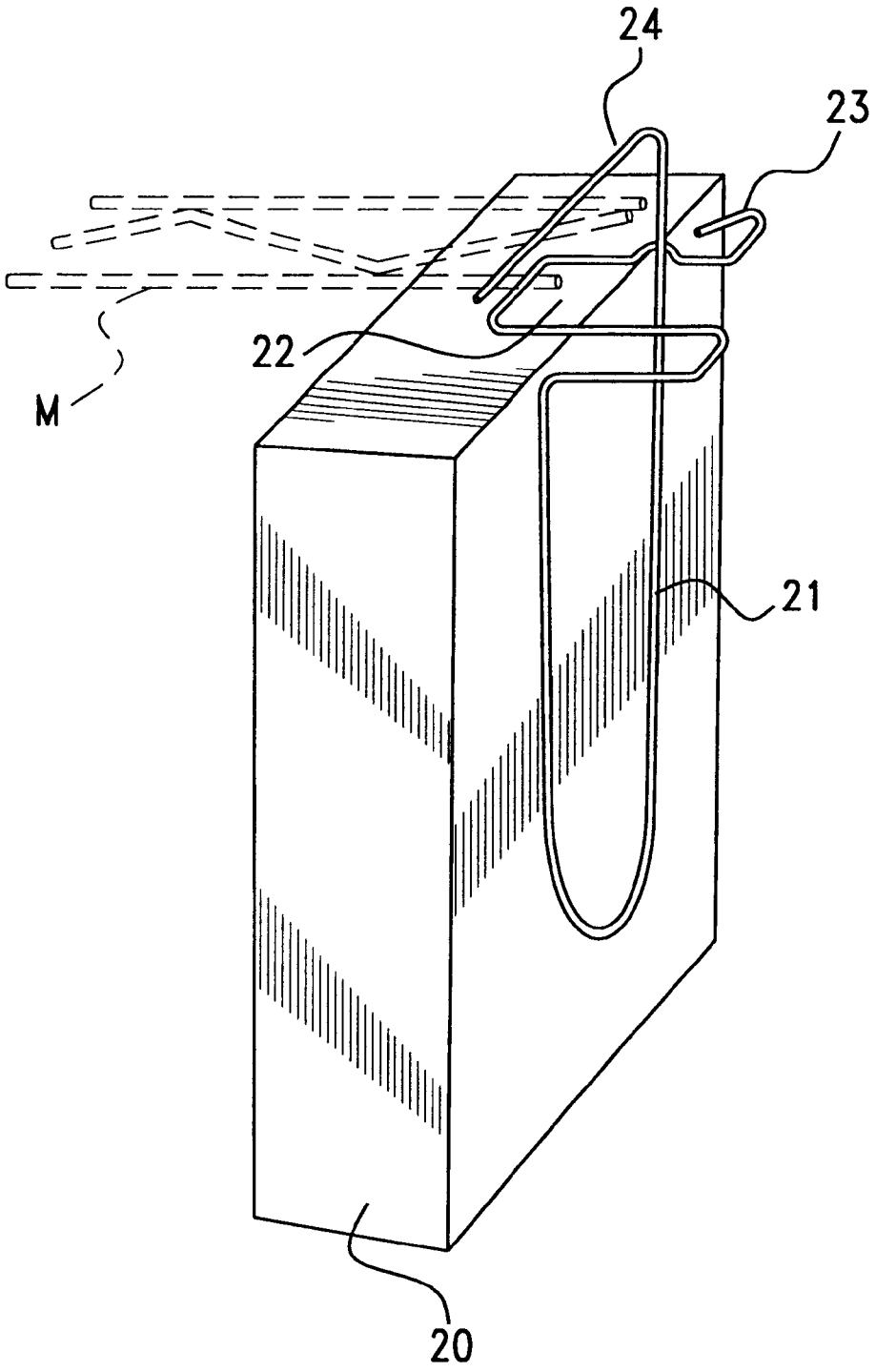
FIG. 2 shows the positioning of such a reinforcement stirrup in relation to a constructional element.

FIG. 2 shows a schematic view of the positioning of a reinforcement stirrup according to the invention in relation to a constructional element. The constructional element is marked with the reference 20 and the reinforcement stirrup with 21; it will be noted that plane 22 of the support section is flush against the upper surface of the constructional element 20, while the reinforcement stirrup positioning means 23 with its extremity lies against the edge of the constructional element 20, and in this way it can be placed in a reproducible manner.

The hook 24 protrudes above the plane of the support section 22, it is more or less parallel to the joint between the constructional element 20 and the adjacent element (not shown), and it makes the positioning of an essentially horizontally oriented reinforcing material exceptionally easy and reproducible. The hook 24 extends in a plane that is essentially parallel to the plane of the support section 22.

The hook is preferably rectilinear in shape; other shapes may also occur, such as corrugated. The shape of the reinforcement stirrup according to the invention ensures that its placement is equally user-friendly for left-handed and for right-handed users.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. Reinforcement stirrup made of wire material for use in masonry, comprising:

a) an essentially flat support section and at least one flat stirrup leg which, when the reinforcement stirrup is in use, extends essentially vertically away from the essentially flat support section for inclusion in a joint between constructional elements;

b) positioning means for an essentially horizontally extended main reinforcement, which positioning means, in use, extends from a plane of the essentially flat support section and lies essentially outside this plane and extends in a direction opposite to that of the at least one stirrup leg;

c) a plane of the at least one stirrup leg intersecting the plane of the essentially flat support section within the bounds of the essentially flat support section;

d) the positioning means being formed by a hook with a stem of the hook extending from the plane of the support section and an arm of the hook extending essentially parallel to the essentially flat support section;

e) the arm of the hook being situated at a distance from the plane of the essentially flat support section, and which distance is substantially equal to a thickness of the essentially horizontally extended main reinforcement; and f) the arm being open at a front of the masonry, in use, so that the main reinforcement can be pushed in from the front of the masonry, in use.

2. Reinforcement stirrup according to claim 1, wherein:

a) the arm of the hook extends in a plane in which the plane of the at least one stirrup leg also extends.

3. Reinforcement stirrup according to claim 1, wherein:

a) a further reinforcement stirrup positioning means is provided for positioning the reinforcement stirrup in relation to a constructional element with which it cooperates, in use.

4. Reinforcement stirrup according to claim 3, wherein:

a) the further reinforcement stirrup positioning means originates from the plane of the essentially flat support section and extends below the plane of a support section to a side of the at least one stirrup leg.

5. Reinforcement stirrup according to claim 3, wherein:

a) the further reinforcement stirrup positioning means has the form of a protruding section having an end, and the end lies essentially in a plane in which the at least one flat stirrup leg lies.

6. Reinforcement stirrup according to claim 1, wherein the reinforcement stirrup includes a single piece of wire.

7. Reinforcement stirrup according to claim 6, wherein:

a) the piece of wire includes a steel wire.

8. Reinforcement stirrup according to claim 7, wherein the steel wire is provided with adhesion-promoting profiles.

9. Masonry provided with at least one essentially horizontally oriented reinforcement which is positioned with the aid of reinforcement stirrups, each of the reinforcement stirrups being made of wire material and comprising:

a) an essentially flat support section and at least one flat stirrup leg which, when the reinforcement stirrup is in use, extends essentially vertically away from the essentially flat support section for inclusion in a joint between constructional elements;

b) positioning means for an at least one essentially horizontally oriented reinforcement, which positioning means, in use, extends from a plane of the essentially flat support section and lies essentially outside this plane and extends in a direction opposite to that of the at least one stirrup leg;

c) a plane of the at least one stirrup leg intersecting the plane of the essentially flat support section within the bounds of the essentially flat support section;

d) the positioning means being formed by a hook with a stem of the hook extending from the plane of the support section and an arm of the hook extending essentially parallel to the essentially flat support section;

e) the arm of the hook being situated at a distance from the plane of the essentially flat support section, and which distance is substantially equal to a thickness of the essentially horizontally oriented reinforcement; and f) the arm being open at a front of the masonry, in use, so that the reinforcement can be pushed in from the front of the masonry, in use.

10. Reinforcement stirrup made of wire material for use in masonry, comprising:

a) an essentially flat support section and at least one flat stirrup leg which, when the reinforcement stirrup is in use, extends essentially vertically away from the essentially flat support section for inclusion in a joint between constructional elements;

b) a positioning element for an essentially horizontally extended main reinforcement, which element, in use, extends from a plane of the essentially flat support section and lies essentially outside the plane and extends in a direction substantially opposite to that of the at least one stirrup leg;

c) a plane defined by the at least one stirrup leg intersecting the plane of the essentially flat support section within the bounds of the essentially flat support section;

d) the positioning element being defined by a hook having an upright, the upright of the hook extending away from the plane of the support section and an arm of the hook extending essentially parallel to the essentially flat support section;

e) the arm of the hook being situated at a distance from the plane of the essentially flat support section, which distance is substantially equal to a thickness of the essentially horizontally extended main reinforcement; and f) the arm being open at a front of the masonry, in use, so that the reinforcement can be pushed in from the front of the masonry toward the masonry, in use.

11. Reinforcement stirrup according to claim 10, wherein:

a) the arm of the hook extends in a plane in which the plane defined by the stirrup leg extends.

12. Reinforcement stirrup according to claim 10, wherein:

a) a further reinforcement stirrup positioning element is provided for positioning the reinforcement stirrup in relation to a constructional element with which it cooperates, in use.

13. A wire masonry reinforcement stirrup, comprising:

a) a support section;

b) a stirrup leg, the stirrup leg extending in a direction away from the support section, the stirrup leg being configured for inclusion in a joint between construction elements, in use;

c) a positioner extending from a plane defined by the support section, and the positioner extending in a direction away from the direction of extension of the stirrup leg;

d) the positioner being configured for use with an extended reinforcement;

e) the positioner including a hook having an upright section and an arm, the upright section extending away from the plane defined by the support section, and the arm of the hook extending away from the upright section;

f) a portion of the arm of the hook being disposed at a distance from the plane defined by the support section, the distance being substantially the same as a thickness of a substantially horizontally extending main reinforcement, in use;

g) the arm being sufficiently open at a front of the masonry, in use, so that an extended reinforcement can be inserted from the front of the masonry, in use; and h) the further positioner originating from the plane defined by the support section and extending below the plane defined by the support section.

14. Reinforcement stirrup according to claim 13, wherein:

a) the arm of the hook extends in a plane in which the plane defined by the stirrup leg also extends.

15. Reinforcement stirrup according to claim 13, wherein:

a) the further positioner is provided for positioning the reinforcement stirrup in relation to a construction element, in use.

16. Reinforcement stirrup according to claim 13, wherein the reinforcement stirrup includes a single piece of wire.

17. Reinforcement stirrup according to claim 16, wherein:

a) the piece of wire includes a steel wire.

18. Reinforcement stirrup according to claim 17, wherein the steel wire is provided with adhesion-promoting profiles.

19. Reinforcement stirrup according to claim 13, wherein:

a) the support section is welded to the positioner.

20. Reinforcement stirrup according to claim 13, wherein:

a) the arm of the hook extends in a plane substantially parallel to the plane defined by the support section.

21. Reinforcement stirrup according to claim 13, wherein:

a) a positioning indentation is provided between the support section and the upright section.

22. Reinforcement stirrup according to claim 21, wherein:

a) the positioner extends in a direction opposite to the direction of extension of the stirrup leg.

23. A wire masonry reinforcement stirrup, comprising:

a) a support section;

b) a stirrup leg, the stirrup leg extending in a direction away from the support section, the stirrup leg being configured for inclusion in a joint between construction elements, in use;

c) a positioner extending from a plane defined by the support section, and the positioner extending in a direction away from the direction of extension of the stirrup leg;

d) the support section being welded to the positioner;

e) the positioner being configured for use with an extended reinforcement;

f) the positioner including a hook having an upright section and an arm, the upright section extending away from the plane defined by the support section, and the arm of the hook extending away from the upright section;

g) a portion of the arm of the hook being disposed at a distance from the plane defined by the support section, the distance being substantially the same as a thickness of a substantially horizontally extending main reinforcement, in use; and h) the arm being sufficiently open at a front of the masonry, in use, so that an extended reinforcement can be inserted from the front of the masonry, in use.

24. Reinforcement stirrup according to claim 23, wherein:

a) the arm of the hook extends in a plane in which the plane defined by the stirrup leg also extends.

25. Reinforcement stirrup according to claim 23, wherein:

a) a further positioner is provided for positioning the reinforcement stirrup in relation to a construction element, in use.

26. Reinforcement stirrup according to claim 23, wherein:

a) a further positioner originates from the plane defined by the support section and extends below the plane defined by the support section.

27. Reinforcement stirrup according to claim 23, wherein the reinforcement stirrup includes a single piece of wire.

28. Reinforcement stirrup according to claim 23, wherein the reinforcement stirrup includes a steel wire.

29. Reinforcement stirrup according to claim 28, wherein the steel wire is provided with adhesion-promoting profiles.

30. Reinforcement stirrup according to claim 23, wherein:

a) the arm of the hook extends in a plane substantially parallel to the plane defined by the support section.

31. Reinforcement stirrup according to claim 23, wherein:

a) the positioner extends in a direction opposite to the direction of extension of the stirrup leg.

32. A wire masonry reinforcement stirrup, comprising:

a) a support section;

b) a stirrup leg, the stirrup leg extending in a direction away from the support section, the stirrup leg being configured for inclusion in a joint between construction elements, in use;

c) a positioner extending from a plane defined by the support section, and the positioner extending in a direction away from the direction of extension of the stirrup leg;

d) the positioner being configured for use with an extended reinforcement;

e) the positioner including a hook having an upright section and an arm, the upright section extending away from the plane defined by the support section, and the arm of the hook extending away from the upright section;

f) a portion of the arm of the hook being disposed at a distance from the plane defined by the support section, the distance being substantially the same as a thickness of a substantially horizontally extending main reinforcement, in use;

g) the arm being sufficiently open at a front of the masonry, in use, so that an extended reinforcement can be inserted from the front of the masonry, in use; and h) a positioning indentation is provided between the support section and the upright section.

33. Reinforcement stirrup according to claim 32, wherein:

a) the arm of the hook extends in a plane in which the plane defined by the stirrup leg also extends.

34. Reinforcement stirrup according to claim 32, wherein:

a) a further positioner is provided for positioning the reinforcement stirrup in relation to a construction element, in use.

35. Reinforcement stirrup according to claim 32, wherein:

a) a further positioner originates from the plane defined by the support section and extends below the plane defined by the support section.

36. Reinforcement stirrup according to claim 32, wherein the reinforcement stirrup includes a single piece of wire.

37. Reinforcement stirrup according to claim 32, wherein the reinforcement stirrup includes a steel wire.

38. Reinforcement stirrup according to claim 37, wherein the steel wire is provided with adhesion-promoting profiles.

39. Reinforcement stirrup according to claim 32, wherein:

a) the arm of the hook extends in a plane substantially parallel to the plane defined by the support section.

40. Reinforcement stirrup according to claim 32, wherein:

a) the positioner extends in a direction opposite to the direction of extension of the stirrup leg.

* * * * *